United States Patent [19]

Anderson

[11] Patent Number: 4,660,245

[45] Date of Patent: Apr. 28, 1987

[54] PAINT BRUSH CLEANING STAND

[76] Inventor: Paul D. Anderson, 434 Arroyo Ave., San Leandro, Calif. 94577

[21] Appl. No.: 730,809

[22] Filed: May 6, 1985

[51] Int. Cl.[4] ..... A47L 13/54

[52] U.S. Cl. ..... 15/268; 211/65; 220/90; 248/110; 248/213.2

[58] Field of Search ..... 15/268, 257 R, 246; 211/65, 41, 66, 69, 86; 220/90; 248/110, 213.2; 68/213

[56] References Cited

U.S. PATENT DOCUMENTS

| | | | |
|---|---|---|---|
| 247,167 | 9/1881 | Chase | 211/86 X |
| 731,289 | 6/1903 | Domagola | 220/90 |
| 1,764,763 | 6/1930 | Stang | 248/110 |
| 1,857,617 | 5/1932 | Berdon | 248/213.2 X |
| 2,566,877 | 9/1951 | Dunton | 220/90 |
| 2,703,652 | 3/1955 | Dominik | 211/65 |
| 2,715,478 | 8/1955 | Andersen | 220/90 |
| 2,949,921 | 8/1960 | Boland | 211/66 X |
| 3,185,311 | 5/1965 | Roberts et al. | 248/213.2 X |
| 3,275,187 | 9/1966 | Lamoureaux | 220/90 |
| 3,395,828 | 8/1968 | Schabel | 220/90 |
| 4,225,064 | 9/1980 | Westcott | 220/90 X |

*Primary Examiner*—Chris K. Moore

[57] ABSTRACT

This invention is a stand for use by a painter when he manually cleans a bristle paint brush by combing it with a wire brush or brush comb.

12 Claims, 5 Drawing Figures

PAINT BRUSH CLEANING STAND

BACKGROUND OF THE INVENTION

It is most important that a paint brush be cleaned thoroughly after each use; if it is not cleaned thoroughly the following problems are created:

a. Paint accumulates in the heel, the area of bristles next to the ferrule, and gradually shortens the useable length of the bristles, thus reducing the paint carrying capacity of the brush.
b. Some of the bristles may become stuck together and hardened, causing fingering and reduced flexibility of the bristles. When a brush is in this condition its ability to spread a coating evenly is substantially reduced.
c. The residue in the brush may contaminate the paint the next time the brush is used.
d. The useful life of the brush is shortened.
e. Paint accumulates on the ferrule and the brush loses its neat appearance.

When cleaning a paint brush it is common practice first to work the brush vigorously by hand while using a solvent which is miscible with the type of paint being used. Then, using clean solvent, this process is repeated as many times as is necessary to clean the brush. However, if the paint has started to dry in the brush, this process becomes difficult and time consuming. The problem of removing partially dried paint occurs frequently when water base latex paint is being used, for the latex globules will start to coalesce to form a dry film in a matter of 15 to 30 minutes.

When there is partially dried paint in the brush the following cleaning procedure is considerably more effective and time saving:

a. Soak the brush in the proper solvent for a few minutes.
b. Hold the paint brush firmly on a flat support and manually comb the bristles with a wire brush or brush comb. The combing action is in one direction only, from the heel to the tip of the brush. This combing action loosens and removes the semi-dried paint from the bristles and the ferrule; and it does not injure the paint brush.
c. Using clean solvent, rinse the brush until the wash solvent is not discolored.

DRAWINGS

Figure 1:
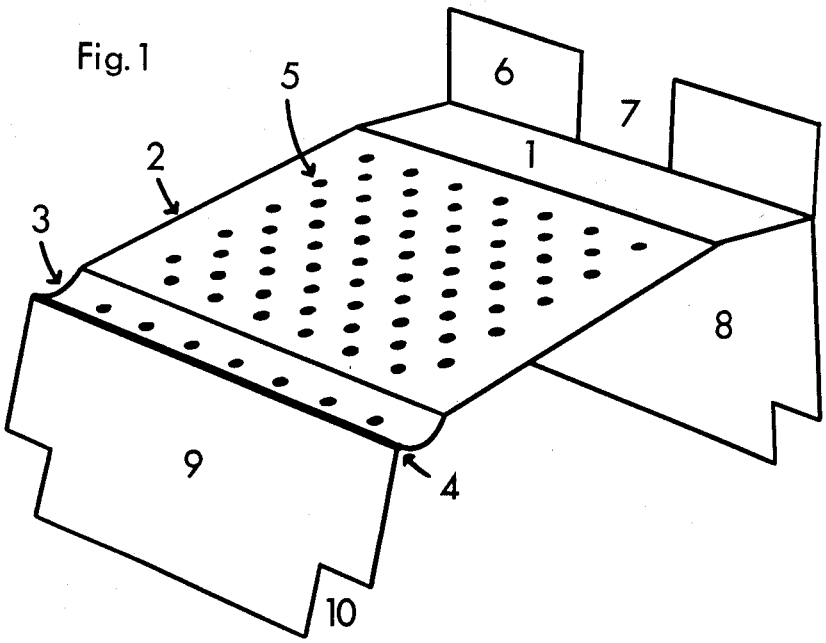

FIG. 1 An isometric projection of the stand, from a sheet metal model.

Figure 2:
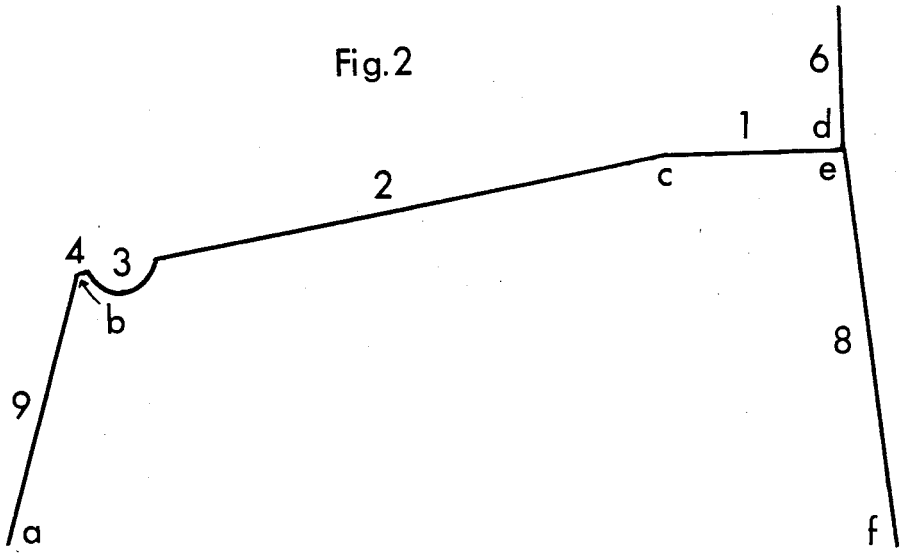

FIG. 2 A side projection of the stand.

Figure 3:
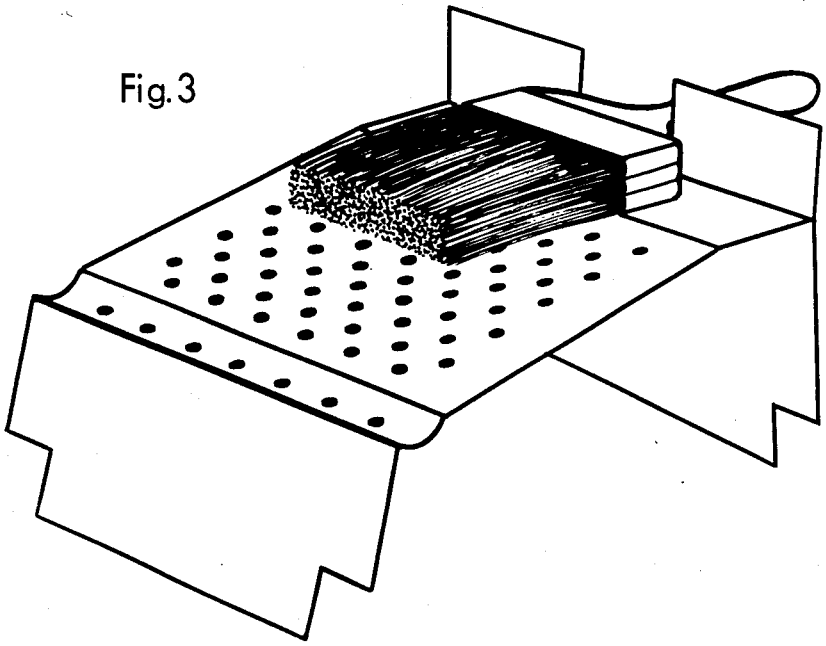

FIG. 3 An isometric projection of the stand with a brush placed on the ferrule support shelf in position for cleaning.

Figure 4:
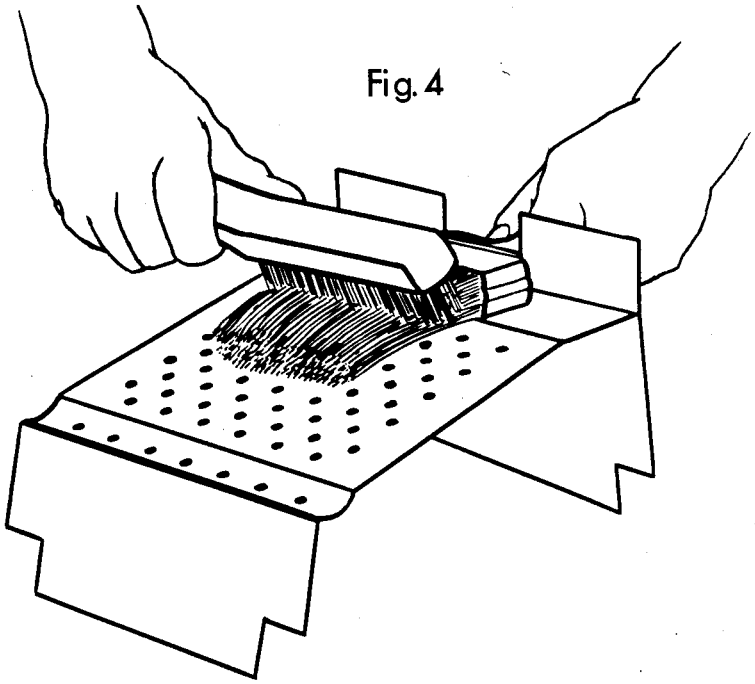

FIG. 4 An isometric projection of the stand in use, illustrating a paint brush being combed with a wire brush.

Figure 5:
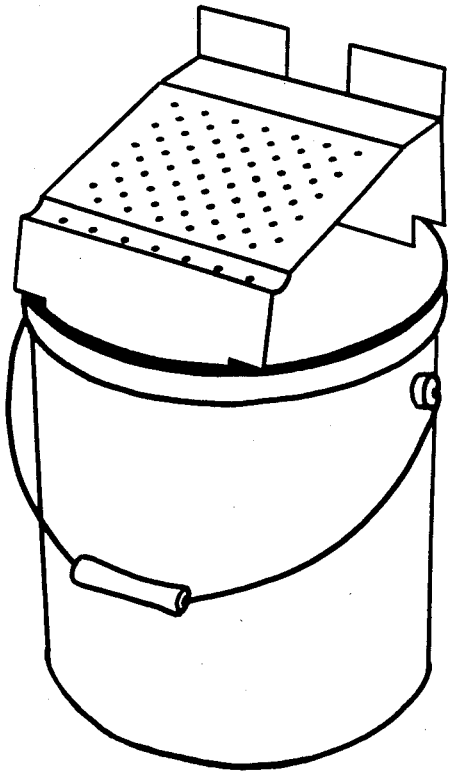

FIG. 5 An isometric projection of the stand seated on a 5 gallon paint pail.

THE INVENTION—DESCRIPTION AND MANNER OF USE

This invention is a stand for use during the combing step, step "b", as described in the foregoing cleaning procedure. Following is a description of its use with references to the drawings:

a. The brush to be cleaned is placed with its ferrule lying flat on the Ferrule Support Shelf 1. Its handle extends through the Brush Handle Notch 7; the bristles extend out over and slightly above the Cleaning Platform 2, as in FIG. 3.
b. The painter holds the handle of the paint brush with one hand and, using a wire brush or brush comb in the other hand, combs the bristles using straight strokes from the heel to the tip of the paint brush. During this combing action the angle between the Ferrule Support Shelf 1 and the Cleaning Platform 2 permits the bristles to be bent down at the heel of the brush, an action which greatly facilitates the removal of paint from that area (see FIG. 4). The paint brush is rotated and combed in the same manner on each side and each edge.
c. The Hand Guard 6 prevents the painter's hand from being in the area where it could be scratched by the wire brush.
d. The height of the Rear Leg 8 is adequate to position the painter's hand conveniently above floor level.
e. Wash solvent and the residue being removed from the paint brush drain through the Drain Holes 5 in the Cleaning Platform 2 and the Drain Trough 3.
f. The legs 8 & 9 are indented at the four bottom corners. These indentations permit the stand to seat onto the rim of a standard $11\frac{1}{4}$ inch diameter 5 gallon paint pail (see FIG. 5). When used in this manner the residue and solvent from the brush cleaning procedure drain into the pail. Cleaning a brush over a pail is both neat and economical. When organic solvents such as mineral spirits, alcohol or lacquer thinner are used in the brush cleaning procedure and are collected in a pail, the particles of paint settle out and, except for the final rinsing, the solvent in the pail can be re-used many times. Additionally, when the stand is seated on a 5 gallon pail, the elevated position is more convenient to use than when the stand is used at floor level.

A stand designed for cleaning the most commonly used sizes of paint brushes, those ranging from 1 to 6 inches in width, would have the following dimensions and specifications:

(1) Ferrule Support Shelf—width 8 in., length 2 in.
(2) Cleaning Platform—width 8 in., length $5\frac{3}{4}$ in.
(3) Drain Trough—at the lower end of the platform, $\frac{3}{4}$ in. from front to back, $\frac{1}{4}$ in. deep, extending the width of the platform, with a row of 7 drain holes at the bottom of the trough.
(4) Lip—width 8 in., length $\frac{1}{8}$ in.
(5) Drain Holes—65 holes, $\frac{1}{4}$ in. in diameter, evenly spaced over the Cleaning Platform, and a row of 7 at the bottom of the Drain Trough.
(6) Hand Guard—width 8 in., height $1\frac{1}{2}$ in.
(7) Brush Handle Notch—2 inches wide, in the center of the Hand Guard 6, extending to the Ferrule Support Shelf 1.
(8) Rear Leg—width 8 in., height $4\frac{1}{4}$ in.
(9) Front Leg—width 8 in., height 3 in.
(10) Indented Corners of the legs—each of the 4 leg corners is indented 1 inch in from the side and 1 inch in from the end of the leg.

Angle a, floor level to Front Leg—75 degrees.
Angle b, Front Leg to Lip and Cleaning Platform—117 degrees.
Angle c, Cleaning Platform to Ferrule Support Shelf—170 degrees.
Angle d, Hand Guard to Ferrule Support Shelf—90 degrees.

Angle e, Ferrule Support Shelf to Rear Leg—96 degrees.

Angle f, Rear Leg to floor level—82 degrees.

The stand can be made from sheet metal, wood, or plastic. The thickness of the component parts will be determined by the strength of the material used.

I do not wish to be limited to this one size and specification. The foregoing specifications are those for a stand designed to accomodate paint brushes from 1 to 6 inches in width. The stand would be proportioned quite differently when made specifically for other types and sizes of brushes, such as a ¼ inch wide artist brush or a 36 inch wide roof coating brush. The configuration and size of the holes can be substantially different without effecting the operation materially. When not designed specifically for use on a solvent collecting pail the leg indentations could be omitted.

Accordingly the full scope of the invention should be determined by the appended claims and their legal equivalents, and not by the examples given.

I claim, in a stand for use when manually cleaning paint brushes by a combing technique, the combination of:

1. A stand for holding a paintbrush above a pail to enable said paintbrush to be readily cleaned manually by a combing process with a wire brush or the like, said stand comprising:

a support shelf for supporting said paintbrush in a substantially horizontal position, the opposite ends of said support shelf having a pair of oppositely-facing edges, said support shelf having a pair of legs depending down from said oppositely-facing edges thereof when said shelf is in a horizontal position, said legs being (a) substantially as wide as said oppositely-facing edges, and (b) substantially perpendicular to said support shelf so that said shelf interconnects said legs and so that said shelf and said legs form a substantially U-shaped structure, the end of each of said legs distal from said support shelf having a free edge, said free edge having a pair of opposite ends, each end of said free edge having an indentation such that the end of each leg has a projecting tongue and a pair of shoulders at opposite sides of the base of said tongue, said shoulders facing downwardly when said support shelf is positioned horizontally, each leg and its tongue having a predetermined width and the tongues of said respective legs being spaced apart a predetermined distance such that when said stand is placed onto a circular pail having a circular top opening of a predetermined size, said tongues will extend into said opening and said shoulders will be supported on the edges of said opening, whereby when said stand is placed onto said pail, said support shelf will be supported in a substantially horizontal position above said pail to facilitate easy cleaning of said paintbrush when placed onto said support shelf.

2. The stand of claim 1, further including a hand guard comprising a member extending up from one of the edges of said support shelf, said member having a notch therein for receiving the handle of said brush, whereby said member will protect a hand holding said handle from being scratched when said paintbrush is combed by a wire brush.

3. The stand of claim 1 wherein said support shelf has an obtuse angle bend therein parallel to said two edges thereof such that a portion of said support shelf slopes downward to facilitate the cleaning of said brush.

4. The stand of claim 1 wherein said support shelf has a plurality of holes therein to facilitate the draining of said paintbrush during the cleaning thereof.

5. The stand of claim 1 wherein said support shelf has a trough therein adjacent one of the edges thereof, said trough being parallel to said one edge.

6. The stand of claim 1 wherein said stand is made of sheet metal.

7. The stand of claim 1 wherein said stand is made of plastic.

8. The stand of claim 1 further including a hand guard comprising a member extending up from one of the edges of said support shelf, said member having a notch therein for receiving the handle of said brush, whereby said member will protect a hand holding said handle from being scratched when said paintbrush is combed by a wire brush, and wherein said support shelf has an obtuse angle bend therein parallel to said two edges thereof such that a portion of said support shelf slopes downward to facilitate the cleaning of said brush.

9. The stand of claim 1, further including a hand guard comprising a member extending up from one of the edges of said support shelf, said member having a notch therein for receiving the handle of said brush, whereby said member will protect a hand holding said handle from being scratched when said paintbrush is combed by a wire brush, said stand being made entirely of sheet metal.

10. The stand of claim 1, further including a hand guard comprising a member extending up from one of the edges of said support shelf, said member having a notch therein for receiving the handle of said brush, whereby said member will protect a hand holding said handle from being scratched when said paintbrush is combed by a wire brush, said stand being made entirely of plastic.

11. The stand of claim 1, further including a hand guard comprising a member extending up from one of the edges of said support shelf, said member having a notch therein for receiving the handle of said brush, whereby said member will protect a hand holding said handle from being scratched when said paintbrush is combed by a wire brush, and wherein said support shelf has an obtuse angle bend therein parallel to said two edges thereof such that a portion of said support shelf slopes downward to facilitate the cleaning of said brush, and wherein said support shelf has a plurality of holes therein to facilitate the draining of said paintbrush during the cleaning thereof.

12. The stand of claim 1, further including a hand guard comprising a member extending up from one of the edges of said support shelf, said member having a notch therein for receiving the handle of said brush, whereby said member will protect a hand holding said handle from being scratched when said paintbrush is combed by a wire brush, and wherein said support shelf has (a) an obtuse angle bend therein parallel to said two edges thereof such that a portion of said support shelf slopes downward to facilitate the cleaning of said brush, (b) said support shelf has a plurality of holes therein to facilitate the draining of said paintbrush during the cleaning thereof, and (c) said support shelf has a trough therein adjacent one of the edges thereof, said trough being parallel to said one edge.

* * * * *